US005257887A

United States Patent [19]

Kregl

[11] Patent Number: 5,257,887

[45] Date of Patent: Nov. 2, 1993

[54] COLLECTION CONTAINER AND METHOD

[75] Inventor: John W. Kregl, Lake Wales, Fla.

[73] Assignee: Petersen Industries, Inc., Lake Wales, Fla.

[21] Appl. No.: 702,590

[22] Filed: May 17, 1991

[51] Int. Cl.[5] ..... B65F 1/12

[52] U.S. Cl. ..... 414/411; 414/608; 414/624; 414/626; 294/68.23; 220/908

[58] Field of Search ..... 414/403, 411, 422, 608, 414/624, 626; 220/908; 232/43.1, 44; 292/201; 49/40, 41; 294/68.23

[56] References Cited

U.S. PATENT DOCUMENTS

| | | | |
|---|---|---|---|
| 2,313,882 | 3/1943 | Litman | 294/68.23 |
| 2,713,419 | 7/1955 | Hayes | 414/626 |
| 3,018,945 | 1/1962 | Day | 232/44 X |
| 3,975,044 | 8/1976 | Briggs | 294/68.23 |
| 4,275,830 | 6/1981 | McDonald | 232/43.1 |
| 4,405,167 | 9/1983 | Kinshofer | 294/68.23 |
| 4,863,053 | 10/1989 | Oberg | 414/411 X |
| 4,913,301 | 4/1990 | Pickler | 414/403 |
| 5,046,614 | 9/1991 | Torres et al. | 220/908 X |

FOREIGN PATENT DOCUMENTS

| | | | |
|---|---|---|---|
| 1101721 | 3/1961 | Fed. Rep. of Germany | 414/626 |
| 372166 | 10/1939 | Italy | 294/68.23 |
| 0447530 | 3/1968 | Switzerland | 294/68.23 |
| 1418231 | 8/1988 | U.S.S.R. | 414/422 |
| 1507672 | 9/1989 | U.S.S.R. | 414/411 |
| 1557070 | 4/1990 | U.S.S.R. | 294/68.23 |
| 1013529 | 12/1965 | United Kingdom | 294/68.23 |

*Primary Examiner*—Michael S. Huppert
*Assistant Examiner*—Stephen T. Gordon
*Attorney, Agent, or Firm*—Robert W. Duckworth; Robert L. Wolter

[57] ABSTRACT

A collection container adapted to be lifted and emptied with a grasping device. The container forms an enclosure with two sections each having a projection and being pivotally connected to each other. The sections are held together with a spring. The container includes an opening to receive objects. The spring tension is set so that the grasping device can lift the container by the projections without the section separating. The projections are angled on the enclosure so that if the grasping device were to squeeze the projections together the two sections would pivotally open and dump the objects in a bin. A trough is coupled to a slot on the container to prevent the container's contents from being pilfered.

9 Claims, 2 Drawing Sheets

COLLECTION CONTAINER AND METHOD

BACKGROUND OF THE INVENTION

This invention relates generally to collection containers and more particularly to a method and apparatus for storing objects and other fungible materials such as trash, fertilizer, solid waste, garbage, recyclable material, fruit, etc. in a container. More specifically, this invention relates to a storage container that is adapted to be lifted and pivotally opened to dump its contents.

One type of prior art collection container holds trash or garbage. This container is adapted to mate with a garbage truck fork arm and has a roof that pivots when tilted. To dump this container's contents the arm is moved into position to contact the container. The arm then lifts up and tilts the container so that the roof pivots open to dump the container's contents. The arm then restores the container back to its original position and the roof pivots shut.

A drawback to these containers is that they usually have a roof or a sliding door which may be opened to deposit trash. The roof and the doors may be incidentally left open. Consequently, the container's contents and smell may be carried away in the wind. When the containers are left open, bugs and vermin access the containers causing a health hazard. Often recyclable trash, such as aluminum cans, is deposited in these containers. Certain recyclable trash may be resold. Unless the door is locked, the container is often opened and its contents pilfered.

Many municipalities have loading arms such as those described in U.S. Pat. No. 4,012,069. These loading arms have a clam shell type gripper that is generally used to pick up tree limbs and deposit those limbs into a waste truck. A drawback to the prior art collection containers is that they are not easily adapted to be dumped with clam shell type grippers on these loading arms.

SUMMARY OF THE INVENTION

An object of this invention is to provide a collection container that can dump its contents into a truck using a loading arm.

Another object of this invention is to deposit trash or fungible items in a container using a trough that remains closed to prevent contents from spilling during high winds.

Also an object of this invention is to construct a trash container having a device that prevents the container's contents from being pilfered.

An additional object of this invention is to enclose trash while preventing bugs and vermin from entering the enclosure.

It is also an object of the invention to improve the method of storing and dumping trash.

A further object of the invention is to adapt a collection container that can be picked up with a clam shell gripper of a loader. Using a loader to dump trash allows municipalities to have their loaders function in dual capacities, i.e. both as a tree limb collection device and as a trash collection device.

These and other objects are provided with a container adapted to be lifted and emptied with a loader having a clam shell that is adapted to squeeze, the container comprises an enclosure having a first section pivotally coupled to a second section. The container also includes first means and second means respectively coupled to the first and second sections for mating with the clam shell of the loader. The container maintains the first section against the second section when the first and second means mate with the clam shell of the loader. The first section pivotally separates from the second section when the clam shell squeezes to draw the first means toward the second means. Thus, a clam shell may be used to empty containers as well as to collect tree limbs.

The above invention may further be practiced by a method of storing and dumping objects from a container comprising the steps of resting a container on the ground having a first and second projection mounted thereon and depositing trash or other objects through an aperture in the container. Disposed below the aperture in the container is a trough that catches the trash. The trough then rotates to deposit the trash in the container. As the trough seals the container at all times, the container's contents are not exposed, thereby preventing the contents from escaping. The first and second projections are then grasped with a clam shell on a loader arm which raises the first and second projections. The container is then raised, moved to a location where trash within the container is to be dumped. Once in position, the first and second projections are squeezed together with the clam shell resulting in the container pivotally opening up and dumping the objects.

DESCRIPTION OF THE PREFERRED EMBODIMENTS

Figure 1:
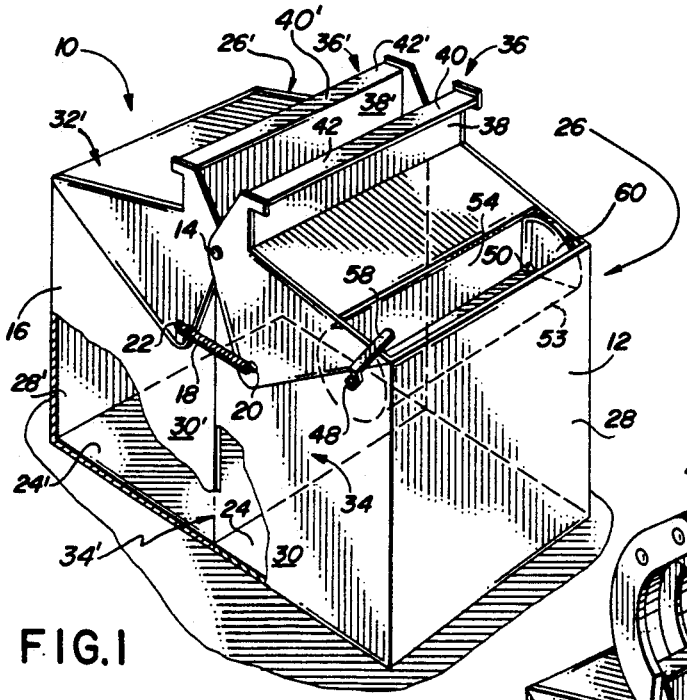
FIG. 1 is a perspective view of the collection container in its storing position with a portion of the container partially cutaway.
Figure 2:
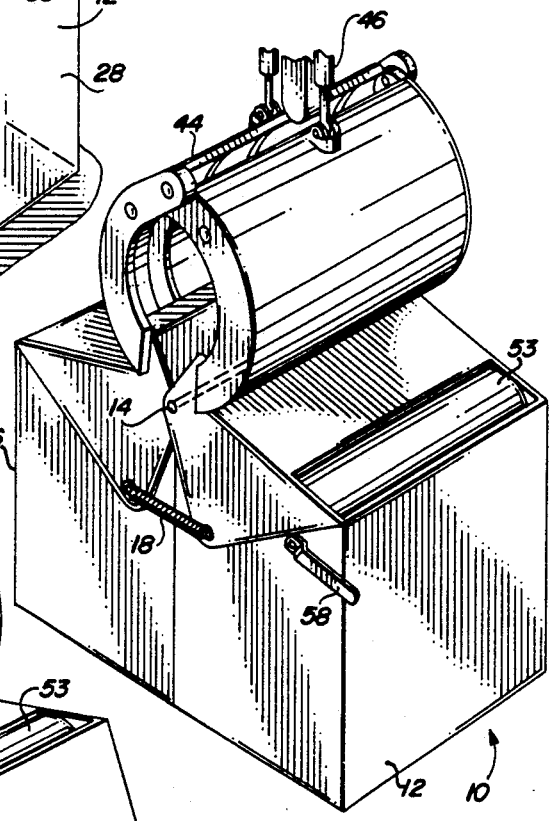
FIG. 2 is a perspective view of the collection container shown in FIG. 1 as it is lifted.
Figure 3:
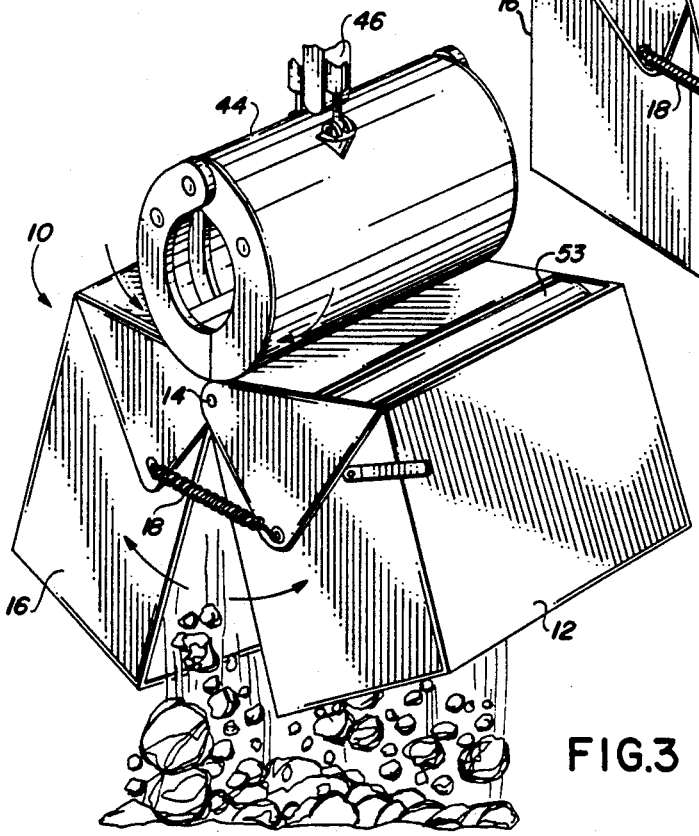
FIG. 3 is a perspective view of the collection container shown in FIG. 1 as its contents are being dumped.

Referring to FIG. 1 through FIG. 3 there is shown a collection container 10 having a first section 12 pivotally connected with pivot rod 14 to second section 16. Container 10 contains spring 18 connected to first section 14 through screw 20 and connected to second section 16 through screw 22. Spring 18 biases first section 12 against second section 16 when container 10 is lifted.

First section 12, which is shaped identically to second section 16, includes a floor 24, sides 26, 28, 30, ceiling 32 and open side 34. Second section 16 also includes floor 24', sides 26', 28', 30', ceiling 32' and open side 34'. The open side 34 of first section 12 faces the open side 34' of second section 16. First section 12 and second section 16 form an enclosure. First section 12 has a first projection 36 and second section 16 has a second projection 36'. Projections 36 and 36' are respectively disposed above ceilings 32 and 32'. Projections 36 and 36' include a first portions 38 and 38', respectively, coupled to second portions 40 and 40', with angled sections 42 and 42' disposed there between. Projections 36 and 36' extend along the length of ceilings 32 and 32'. First portions 38 and 38' extend outward away from open sides 34 and 34'. Second portions 40 and 40' extend parallel to floors 24 and 24', respectively. Referring to FIGS. 2 and 3, projections 36 and 36' are adapted to mate with clam shell 44 connected to loader arm 46 of a loader (not shown).

A trash depositing device 53 is located on first section 12. Device 53 includes trough 54 disposed adjacent to ceiling 32 and coupled to pivot screw 48 and pivot screw 50 on sides 30 and 26. Screw 48 couples trough 54 to rotating arm 58. Extending along ceiling 32 of first section 12 is slot 60. Materials and other objects, such as trash, are deposited into container 10 through slot 60. Trough 54 receives objects deposited in slot 60. Trough 54 may then be pivoted by rotating arm 58 to dump objects in trough 54 onto floor 24 of container 10.

Figure 4:
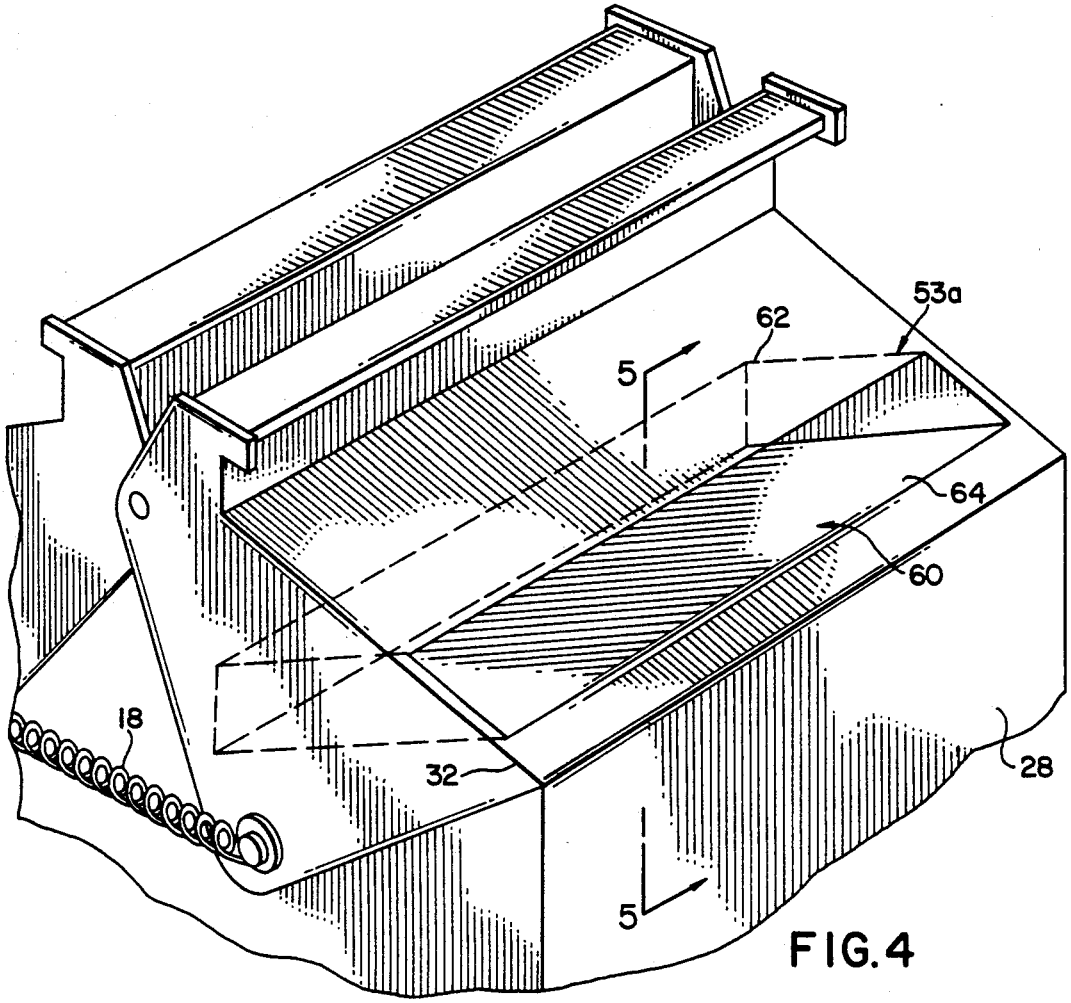
FIG. 4 is a perspective view of an alternate embodiment of the trash deposing device shown in FIG. 1.
Figure 5:
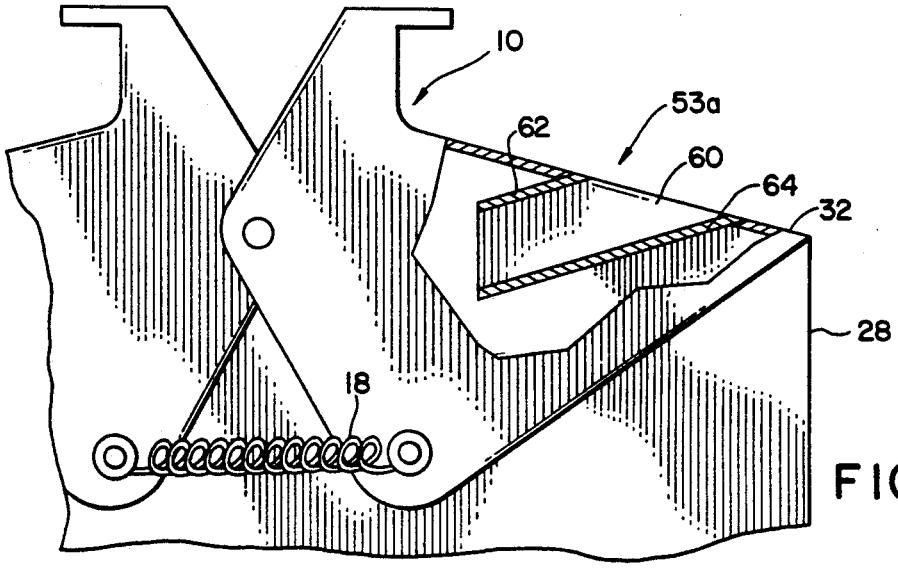
FIG. 5 is a side view of the trash depositing device shown in FIG. 4 cut along line 5—5.

Referring to FIGS. 4 and 5, there is shown trash depositing device 53*a*, an alternate embodiment of trash depositing device 53 shown in FIG. 1. Device 53*a* has slot 60 with first and second parallel extending sheets 62 and 64 which are welded to ceiling 32 adjacent the side of slot 60. Sheets 62 and 64 extend into container 10 preferably at an angle of 75° with respect to side 28. The angle and length of sheets 62 and 64 are selected to prevent a person from reaching through slot 60 to pilfer the contents of container 10.

During operation container 10 rests on the ground in the position shown in FIG. 1. Objects are deposited into container 10 by the method described in the preceding paragraph.

When the contents of container 10 are to be dumped, loader arm 46 extends outward and clam shell 44, also referred to as a grasping device, grapples projections 36 and 36'. Loader arm 46 then lifts clam shell 44 and container 10. Loader arm 46 may then move container 10 in position over a container where the contents of container 10 are to be dumped. Examples of containers include a trash bin of a truck, a bed of a pickup truck, etc.

Referring to FIG. 3, when the material contents of container 10 is to be dumped, clam shell 44 urges projections 36 and 36' together. This urging results in first section 12 and second section 16 pivoting about pivot rod 14 to open container 10. As container 10 is opened, its contents are dumped onto the area below. Once the contents have been dumped, clam shell 44 stops urging projections 36 and 36' together. Spring 18 then urges first section 12 toward second section 16 to close container 10. Loader arm 46 then moves clam shell 44 and container 10 to a location where container 10 is to be placed to collect further material. Once container 10 is placed in its collection location, clam shell 44 is released from projections 36 and 36'.

This concludes the description of the preferred embodiments. A reading by those skilled in the art will bring to mind various changes without departing from the spirit and scope of the invention. It is intended, however, that the invention only be limited by the following appended claims.

What is claimed is:

1. A collection container in combination with a grasping device wherein said collection container is adapted to be lifted and emptied by said grasping device that is adapted to squeeze and pick up objects, the container comprising:

means having a first section pivotally coupled to a second section forming an enclosure for waste material;

first and second means respectively coupled to said first and second sections for mating with the grasping device to squeeze said mating means together and separate the first and second sections; and means for biasing together said first section coupled to said second section when said first and second means mates with, and is lifted by, the grasping device; further wherein said grasping device is normally separate from and not structurally linked to said container.

2. The collection container as recited in claim 1 further comprising means coupled to said first section for permitting material to be deposited into said first section.

3. The collection container as recited in claim 2 wherein said permitting means includes a slot disposed on said first section and a trough pivotally connected to said first section within said enclosure such that when waste material is disposed in said slot said material falls onto said trough.

4. The collection container as recited in claim 1 further comprising a slot on said container through which material may be deposited; and means for preventing a person from reaching through said slot to grab said material and for receiving trash deposited through said slot.

5. A collection container adapted to be lifted and squeezed with a clam shell, the container comprising:

a first section having three sides, an open side, a floor and a ceiling;

a first projection mounted on said first ceiling and being angled away from said open side, said first projection having a means for mating with the clam shell;

a pivot rod connected to said first section;

a second section, having three sides, an open side, a floor and a ceiling, said second section being connected to said first section with said pivot rod wherein said open side of said first section opposingly faces the open side of said second section; and a second projection mounted on said second ceiling and having means for mating with the clam shell so that when said first and second projections are lifted, said first and second sections are lifted, said second projection being angled away from said open side of said second section such that when the clam shell squeezes said first and second projection, said first and second section pivots on said pivot rod to empty said collection container.

6. The collection container as recited in claim 5 further comprising a spring for preventing said first and second sections from pivoting on said pivot rod when said first and second sections are lifted.

7. The collection container as recited in claim 6 further comprising means disposed within said first section for permitting material to be deposited in said collection container.

8. A collection container in combination with a clam shell grasping device wherein said collection container is adapted to be lifted and squeezed with said clam shell grasping device, the container comprising:

(a) a first section pivotally coupled to a second section to form an enclosure for depositing waste materials;

(b) a projection means, adapted to mate with said grasping device, affixed to said first section and pivotally coupled with a second projection means affixed to said second section, to mate with said grasping device for separating said first and second sections when the grasping device squeezes the projection means together; and (c) means for biasing together said first section to said second section when the grasping device mates with the first and second projection means and said container is lifted; further wherein said grasping device is normally separate from and not structurally linked to said container.

9. The collection container as recited in claim 8 further including means, coupled with said first section, for permitting material to be deposited in said first section.

* * * * *